US005437298A

United States Patent [19]

Lin

[11] Patent Number: 5,437,298

[45] Date of Patent: Aug. 1, 1995

[54] SUNSHADE ARRANGEMENT

[76] Inventor: Chen Y. Lin, 5th Fl., No. 58, Lane 185, Chung Cheng Rd., Lu Chou Hsiang, Taipei Hsien, Taiwan

[21] Appl. No.: 156,911

[22] Filed: Nov. 24, 1993

[51] Int. Cl.[6] ..... E04H 15/58

[52] U.S. Cl. ..... 135/117; 135/115; 135/903; 160/46; 160/66; 108/129

[58] Field of Search ..... 160/46, 66, 67, 370.2 A; 135/105, 87, 107, 115, 117, 119, 903; 403/109, 110; 24/339; 108/129, 131

[56] References Cited

U.S. PATENT DOCUMENTS

| | | | |
|---|---|---|---|
| 2,886,047 | 5/1959 | Healy | 135/107 |
| 3,581,436 | 6/1971 | Basiger | 135/87 |
| 4,392,437 | 7/1983 | Wallace | 108/129 X |
| 4,407,472 | 10/1983 | Beck | 24/339 X |
| 4,487,212 | 12/1984 | Moore | 135/117 |
| 4,596,484 | 6/1986 | Nakatami | 403/110 |
| 4,761,092 | 8/1988 | Nakatami | 403/109 |
| 4,862,940 | 9/1989 | Atchison | 160/67 |
| 5,036,898 | 8/1991 | Chen | 160/370.2 A |
| 5,054,533 | 10/1991 | Lii | 160/370.2 R |
| 5,174,352 | 12/1992 | Murray et al. | 160/67 |
| 5,330,251 | 6/1994 | McGuire | 160/370.2 A |

*Primary Examiner*—Carl D. Friedman
*Assistant Examiner*—Wynn E. Wood
*Attorney, Agent, or Firm*—Sixbey, Friedman, Leedom & Ferguson

[57] ABSTRACT

A sunshade arrangement includes first and second pairs of telescopically retractable spaced posts, first and second tubes respectively mounted to upper ends of the first and second pairs of posts, a reel assembly, and a screen. Each post includes a device for controlling telescopical movement. The reel assembly is mounted adjacent to the second tube and includes a reel axle which extends in a direction parallel to the second tube, a torsion spring mounted in each of two ends of the reel axle, an axle coupler mounted to each of the ends of the reel axle to rotate therewith and having a protrusion to which a first end of the torsion spring is securely attached and a through hole extending along a direction parallel to a longitudinal direction of the reel axle, and a U-shaped member having a first end attached to each of the ends of the second tube and a second end passing through the through hole of the axle coupler into an interior space of the reel axle and to which a second end of the torsion spring is securely attached. The screen has a first end securely mounted to the reel axle and a second end securely mounted to the first tube, the screen being spread when in use and being wound around the reel axle by the torsion spring when the sunshade assembly is not in use.

7 Claims, 5 Drawing Sheets

SUNSHADE ARRANGEMENT

BACKGROUND OF THE INVENTION

1. Field of the Invention

The present invention relates to a sunshade arrangement and, more particularly, to a foldable beach sunshade arrangement with height-adjustable post means.

2. Description of Related Art

A sunshade is useful, especially on a beach, to shield people from sunlight or being over-sunburned. A drawback of a conventional sunshade is that it is fixed and thus cannot effectively screen the sunlight when the incident angle thereof changes. Another drawback of the conventional sunshade is that it is not foldable and thus occupies a considerable space which is very inconvenient in carriage and storage and thus limits its application.

Therefore, there has been a long and unfulfilled need for an improved sunshade arrangement to solve these problems mentioned above.

SUMMARY OF THE INVENTION

A sunshade arrangement provided by the present invention includes first and second pairs of spaced post means, first and second tubes respectively mounted to upper ends of the first and second pairs of post means, a reel assembly, and a screen. Each post means includes an outer tubular member, an inner tubular member telescopically received in the outer tubular member, and a means for controlling relative telescopical movement between the inner and outer tubular members.

The reel assembly is mounted adjacent to the second tube and includes a reel axle which extends in a direction parallel to the second tube, a torsion spring mounted in each of two ends of the reel axle, an axle coupler mounted to each of the ends of the reel axle to rotate therewith and having a protrusion to which a first end of the torsion spring is securely attached and a through hole extending along a direction parallel to a longitudinal direction of the reel axle, and a U-shaped member having a first end attached to each of the ends of the second tube and a second end passing through the through hole of the axle coupler into an interior space of the reel axle and to which a second end of the torsion spring is securely attached.

The screen has a first end securely mounted to the reel axle and a second end securely mounted to the first tube, the screen being spread when in use and being wound around the reel axle by the torsion spring when the sunshade assembly is not in use.

Preferably, the means for controlling relative telescopical movement between the inner and outer tubular members includes a sleeve mounted on an upper end of the outer tubular member and including a pair of spaced ears on an outer periphery thereof, a retaining piece mounted between the ears and contacting with an outer periphery of the inner tubular member, and a retaining block pivotally mounted between the ears and including an operative arm and a pressing section with an operative surface. When the operative arm is in a first position, the operative surface exerts an inward and radial force on the retaining piece to frictionally retain the inner tubular member, and when the operative arm is in a position other than the first position, the retaining piece allows relative movement between the inner and outer tubular members.

The post means includes a spike at a lower end thereof so as to pierce into the sands on a beach. A stepping member is mounted to a lower section of the post means to facilitate the mounting of the post means.

Preferably, the post means is articulated to the end of the tube so that the post means can be folded when not in use. A socket means having two receiving seats is provided to hold the respective tube and the associated post means together.

Other objects, advantages, and novel features of the invention will become more apparent from the following detailed description when taken in conjunction with the accompanying drawings.

DESCRIPTION OF THE PREFERRED EMBODIMENT

Figure 1:
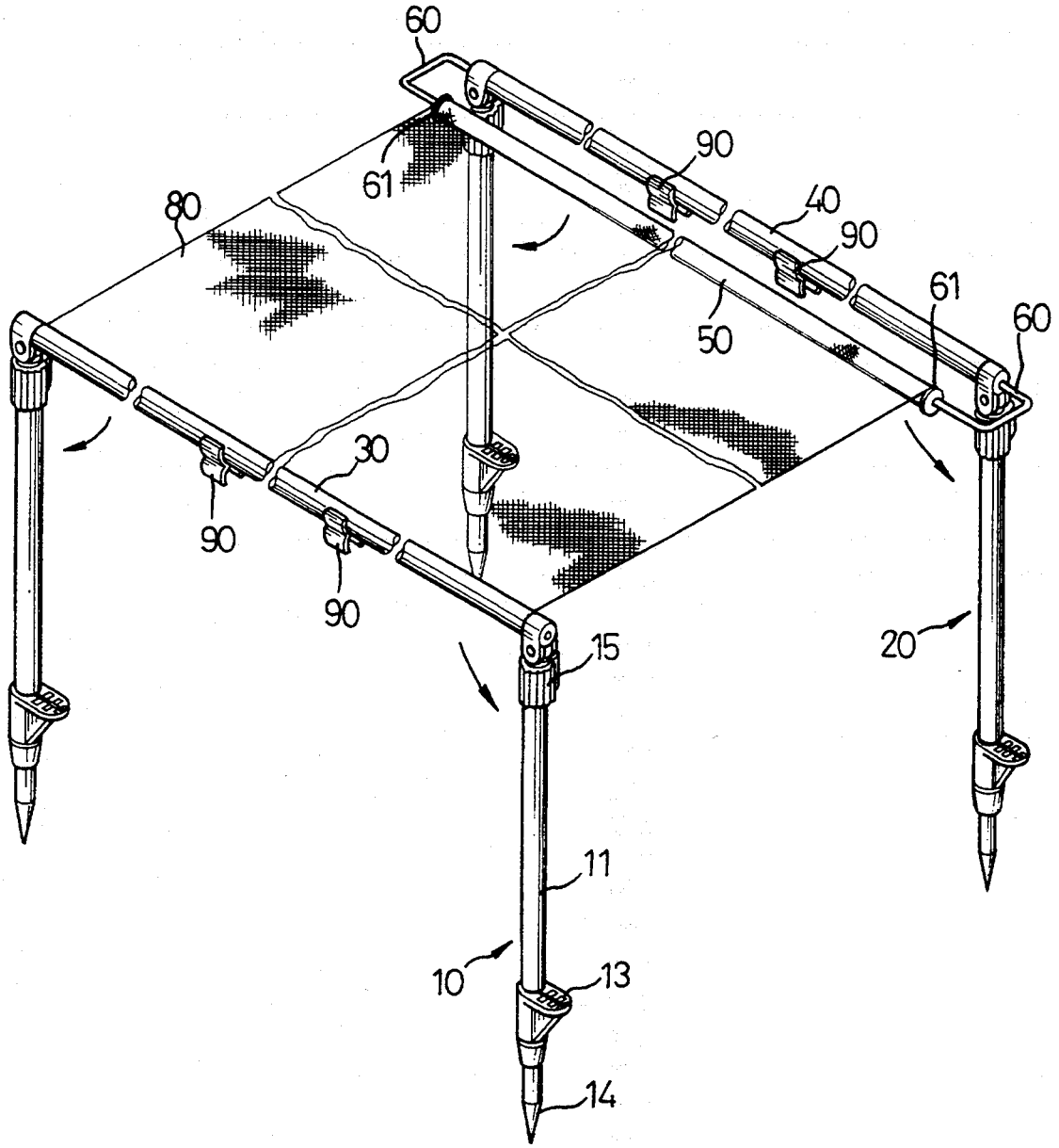
FIG. 1 is a perspective view of a sunshade arrangement in accordance with the present invention.
Figure 2:
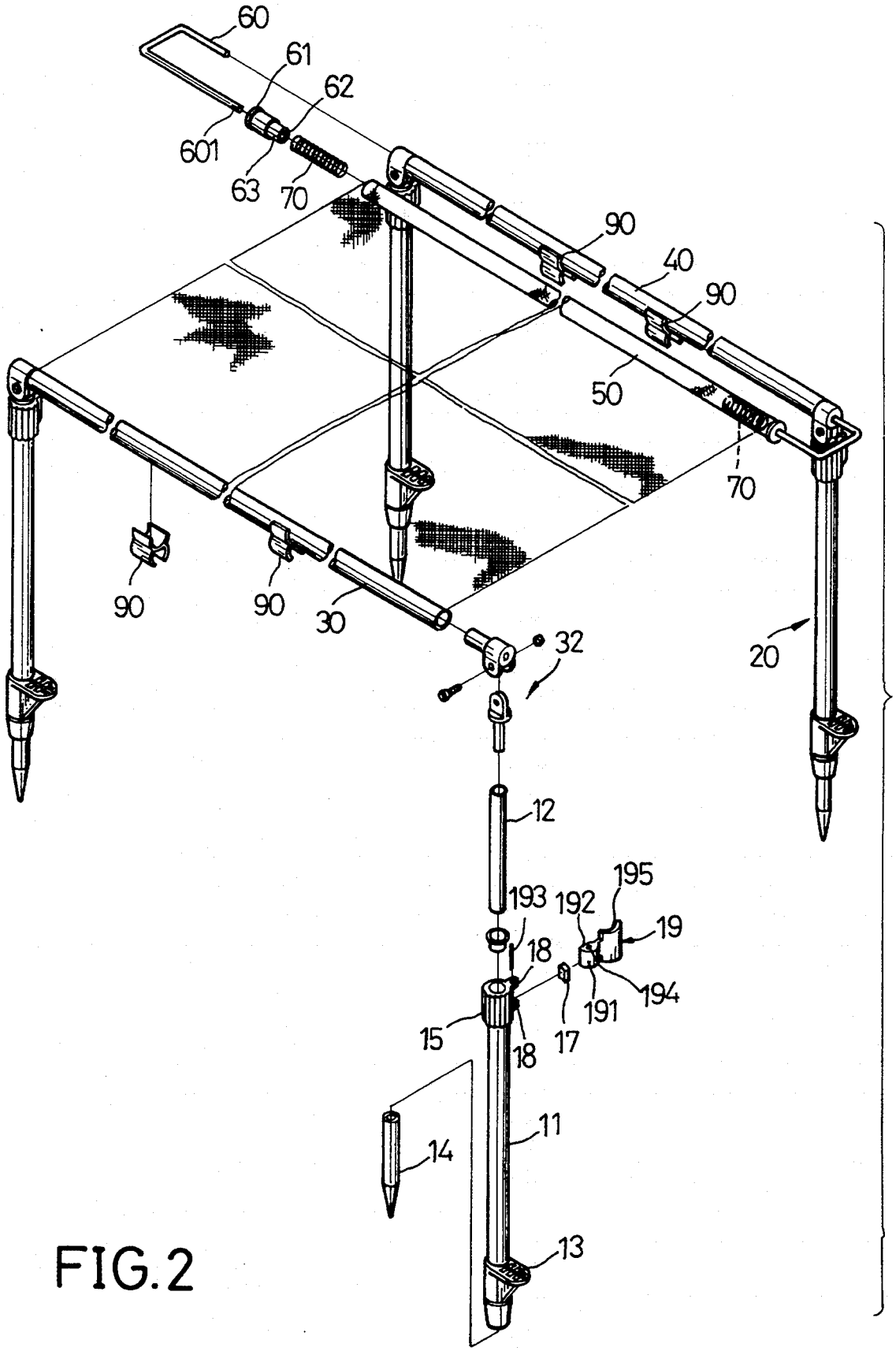
FIG. 2 is an exploded view of the sunshade arrangement.

Referring to the drawings and initially to FIGS. 1 and 2, a sunshade arrangement in accordance with the present invention generally includes two pairs of spaced post means 10 and 20, two hollow tubes 30 and 40 respectively mounted between the two pairs of post means 10 and 20, a reel assembly mounted to hollow tube 40, and a screen 80 for shielding people.

As shown in FIG. 2, each post means 10, 20 includes an outer tubular member 11 and an inner tubular member 12 telescopically received in the outer tubular member 11 and is retained in position by a retaining piece 17 and a retaining block 19 which will be explained later. A spike 14 is provided to a lower end of the outer tubular member 11 to pierce into sands or other suitable ground. A stepping member 13 is mounted to a lower section of the outer tubular member 11 to facilitate the mounting of the post means 10, 20.

Figure 3:
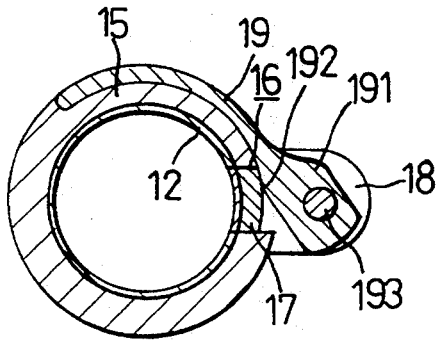
FIG. 3 is a horizontal cross-sectional view illustrating the retaining means for the post means of the sunshade arrangement.

Still referring to FIG. 2 and further to FIG. 3, a sleeve 15 is mounted to an upper end of the outer tubular member 11 and has a pair of vertically-spaced ears 18 formed on an outer periphery thereof. The retaining piece 17 locates between the ears 18 and contacts with an outer periphery of the inner tubular member 12. The retaining block 19 includes an operative arm 195 and a pressing section 191 which has a pin hole 194 therein and an operative surface 192 for applying a radial force to the retaining piece 17 so as to frictionally retain the inner tubular member 12. The retaining block 19 is pivotally mounted between the ears 18 of the sleeve 15 by a pin 193 passing through correspondingly formed holes (not labeled) in the ears 18 and the pin hole 194.

When the operative arm 195 is in a position shown in FIG. 3, the retaining piece 17 is subjected to an inward and radial force by the operative surface 192 to retain the inner tubular member 12. When the operative arm 195 pivots clockwise (see FIG. 3) about the pin 193 to a position where the retaining piece 17 is no more subjected to the inward and radial force, the inner tubular member 12 may move telescopically relative to the outer tubular member 11.

Figure 7:
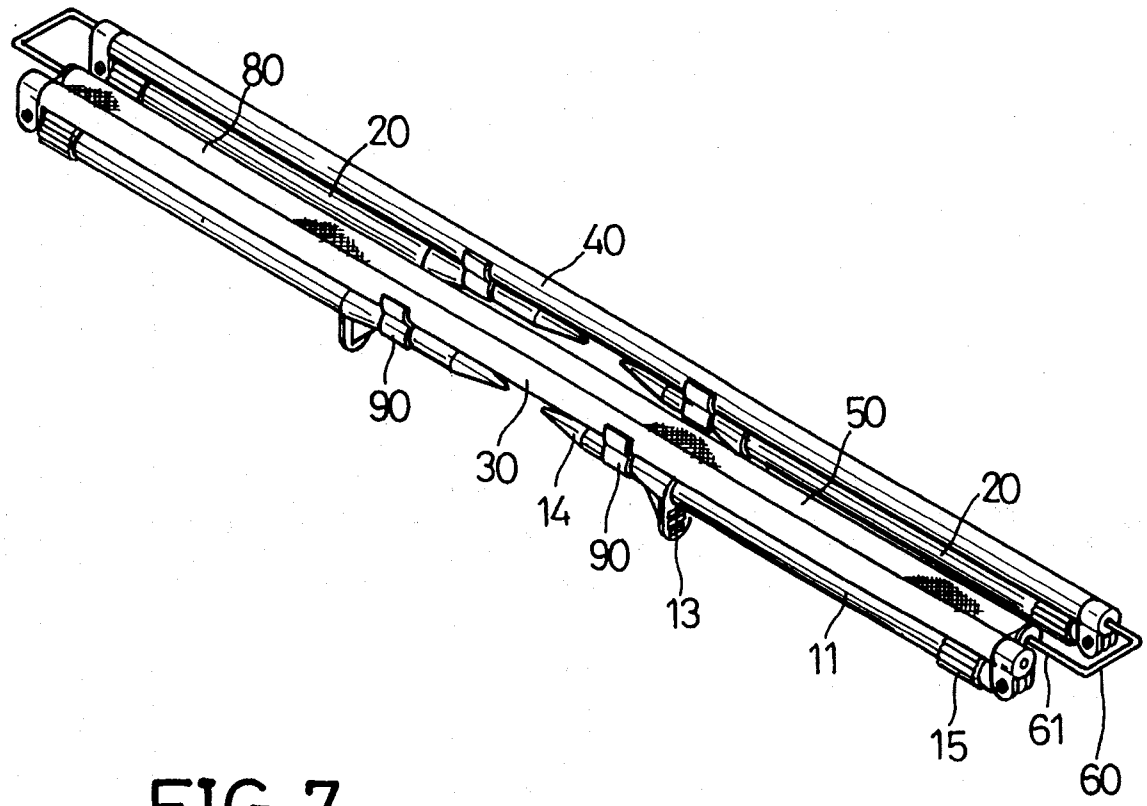
FIG. 7 is a perspective view of the sunshade arrangement in a folded status.

The upper end of the inner tubular member 12 is articulated to one end of the hollow tube 30, 40 by an articulation arrangement 32 (see FIG. 2), such that the whole post means 10 can be folded to a status shown in FIG. 7 when not in use. Socket means 90 having two receiving seats may be used to hold the respective hollow tube 30, 40 and the associated post means 20, 30 together.

Figure 4:
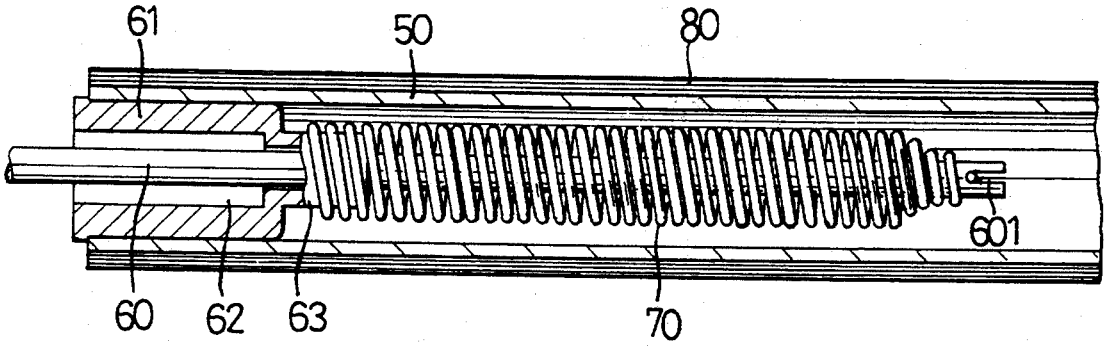
FIG. 4 is a vertical partial cross-sectional view illustrating the torsion spring for re-coiling the screen of the sunshade arrangement.
Figure 5:
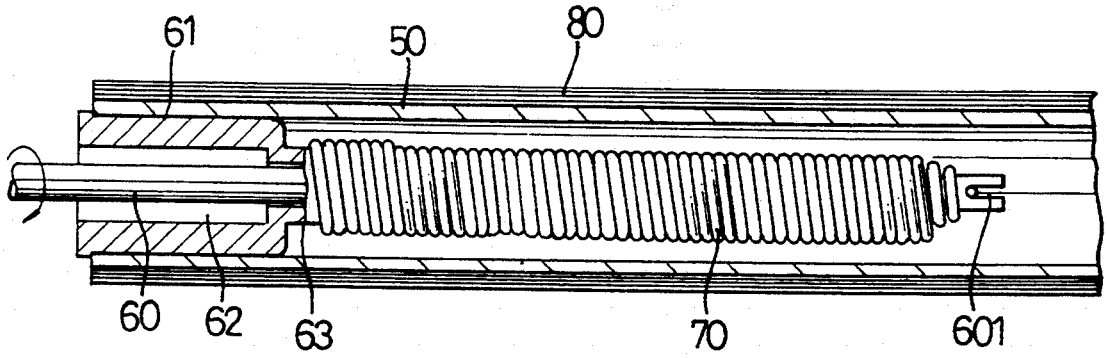
FIG. 5 is a vertical partial cross-sectional view similar to FIG. 4, in which the torsion spring is in a twisted status.

Still referring to FIG. 2 and further to FIG. 4, the reel assembly includes a reel axle 50 which extends in a direction parallel to the hollow tube 40. A torsion spring 70 is mounted in each of two ends of the reel axle 50 and is sealed by an axle coupler 61 which is coupled to each end of the reel axle 50 to rotate therewith and which includes a through hole 62 extending along a direction parallel to a longitudinal direction of the reel axle 50 and a protrusion 63 to which one end of the torsion spring 70 is attached. A U-shaped member 60 has a first end attached to an associated end of hollow tube 40 and a second end 601 passing through the through hole 62 of the axle coupler 61 into an interior space of the reel axle 50 and to which the other end of the torsion spring 70 is attached. An end of the screen 80 is securely attached to the reel axle 50 and the other end of the screen 80 is securely attached to hollow tube 30. The torsion spring 70 in FIG. 4 is in a normal status in which the screen 80 is wound around the outer periphery of the reel axle 50. When the screen 80 is extended, the reel axle 50 together with the shaft coupler 61 rotates and thus twists the torsion spring 70 (see FIG. 5) for re-winding the screen 80 when not in use.

Figure 6:
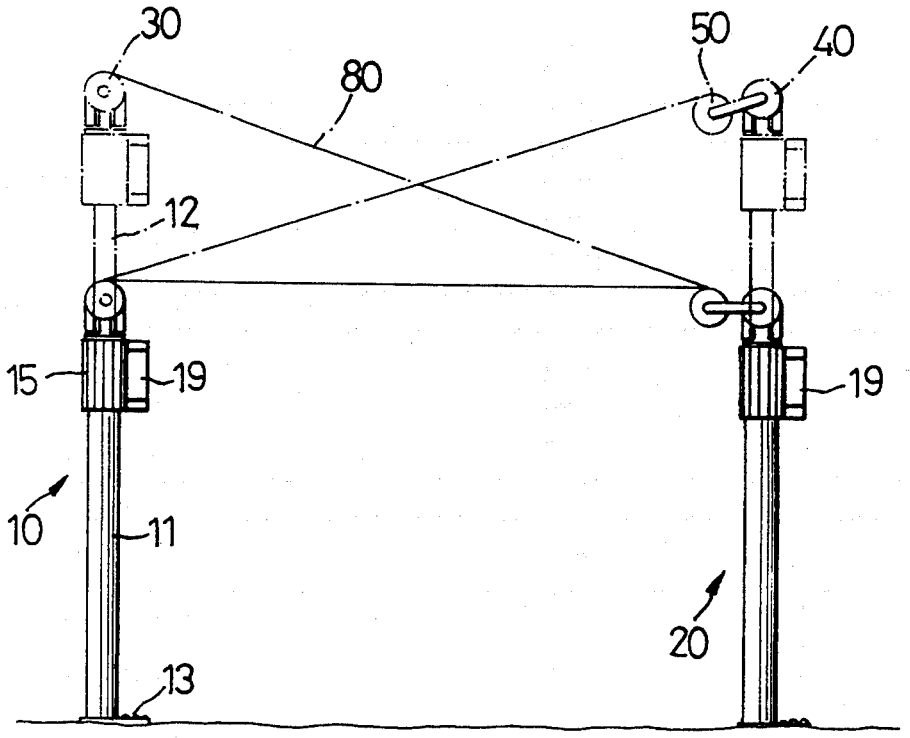
FIG. 6 is a schematic side view illustrating adjustment of the post means of the sunshade arrangement in response to the change of incident orientation of the sunlight.

In use, one pair of the post means 20 are first positioned in the sands on a beach or other suitable grounds by stepping on the stepping member 13. Then, the pair of the first-mentioned pair of post means 10 are moved away from post means 20 to spread the screen 80 and are positioned when the coverage area of the screen 80 is in a desired manner and the installation of the sunshade arrangement is thus completed. Referring to FIG. 6, when the incident angle of sunlight changes to a manner that the screen 80 cannot effectively screen the sunlight, the user may adjust the relative positions of the inner and outer tubular members 11 and 12 of either post means 10 and 20 upon operating the retaining block 19 in manner stated in the above, thereby providing best shielding. When not in use, as previously described, the whole sunshade arrangement can be folded to a status shown in FIG. 7, which is suitable for storage and carriage.

Although the invention has been explained in relation to its preferred embodiment, it is to be understood that many other possible modifications and variations can be made without departing from the spirit and scope of the invention as hereinafter claimed.

I claim:

1. A sunshade arrangement comprising:

first and second pairs of spaced post means (10 and 20) each having upper and lower ends and including an outer tubular member (11) having upper and lower ends, an inner tubular member (12) telescopically received in the outer tubular member (11), and a means for controlling relative telescopical movement between the inner and outer tubular members (11 and 12);

first and second tubes (30 and 40) respectively mounted to the upper ends of the first and second pairs of post means (10 and 20);

a screen (80) having a first end securely mounted to the second tube (40) and a second end securely mounted to the first tube (30); and a socket means (90) having two receiving seats to hold the tubes (30, 40) and the associated post means (10, 20) together in parallel.

2. A sunshade arrangement comprising:

first and second pairs of spaced post means (10 and 20) each having upper and lower ends and including an outer tubular member (11) having upper and lower ends, an inner tubular member (12) telescopically received in the outer tubular member (11), and a means for controlling relative telescopical movement between the inner and outer tubular members (11 and 12);

first and second tubes (30 and 40) respectively mounted to the upper ends of the first and second pairs of post means (10 and 20);

a reel assembly mounted adjacent to the second tube (40) and including:

a reel axle (50) having two ends and extending in a direction parallel to the second tube (40);

a torsion spring (70) mounted in each of the ends of the reel axle (50) and having first and second ends;

an axle coupler (61) mounted to each of the ends of the reel axle (50) to rotate therewith and having a protrusion (63) to which the first end of the torsion spring (70) is securely attached and a through hole (62) extending along a direction parallel to that of the reel axle (50);

a U-shaped member (60) having a first end attached to each of the ends of the second tube (40) and a second end (601) passing through the through hole (62) of the axle coupler (61) into an interior space of the reel axle (50) and to which the second end of the torsion spring (70) is securely attached;

a screen (80) having a first end securely mounted to the reel axle (50) and a second end securely mounted to the first tube (30), the screen (80) being spread when in use and being wound around the reel axle (50) by the torsion spring (70) when the sunshade assembly is not in use.

3. The sunshade arrangement as claimed in claim 2 wherein the means for controlling relative telescopical movement between the inner and outer tubular members (11 and 12) includes:

a sleeve (15) mounted on an upper end of the outer tubular member (11) and including a pair of spaced ears (18) on an outer periphery thereof, a retaining piece (17) mounted between the ears (18) and contacting with an outer periphery of the inner tubular member (12), and a retaining block (19) pivotally mounted between the ears (18) and including an operative arm (195) and a pressing section (194) with an operative surface (192), when the operative arm (195) is in a first position, the operative surface (192) exerts an inward and radial force on the retaining piece (17) to frictionally retain the inner tubular member (12), and when the operative arm (195) is in a position other than the first position, the retaining piece (17) allows relative movement between the inner and outer tubular members (11 and 12).

4. The sunshade arrangement as claimed in claim 2 wherein the post means (10 and 20) further comprises a stepping member mounted to a lower section thereof.

5. The sunshade arrangement as claimed in claim 2 wherein the post means (10 and 20) comprises a spike at a lower end thereof.

6. The sunshade arrangement as claimed in claim 2 wherein each of the tubes (30, 40) has two ends respectively articulated to the upper ends of the associated post means (10, 20).

7. The sunshade arrangement as claimed in claim 2 further comprising a socket means (90) having two receiving seats to hold the tubes (30, 40) and the associated post means (10, 20) together in parallel.

* * * * *